US006236730B1

(12) United States Patent
Cowieson et al.

(10) Patent No.: US 6,236,730 B1
(45) Date of Patent: May 22, 2001

(54) FULL SOUND ENHANCEMENT USING MULTI-INPUT SOUND SIGNALS

(75) Inventors: Brian Cowieson, Airdrie; Terry K. Cashion, Calgary; John Arthur, Calgary; Simon Williams, Calgary, all of (CA)

(73) Assignee: QSound Labs, Inc., Calgary (CA)

( * ) Notice: Subject to any disclaimer, the term of this patent is extended or adjusted under 35 U.S.C. 154(b) by 0 days.

(21) Appl. No.: 08/858,586

(22) Filed: May 19, 1997

(51) Int. Cl.[7] ..... H04R 5/00
(52) U.S. Cl. ..... 381/18; 381/19
(58) Field of Search ..... 381/1, 17, 18, 381/19, 20, 21, 22, 23

(56) References Cited

U.S. PATENT DOCUMENTS 5,436,975 * 7/1995 Lowe ..... 381/17
5,546,465 * 8/1996 Kim ..... 381/17
5,610,985 * 3/1997 Ten Kate ..... 381/27
5,822,438 * 10/1998 Sekine ..... 381/18
5,857,026 * 1/1999 Scheiber ..... 381/23

FOREIGN PATENT DOCUMENTS 13002 2/1975 (JP) .
116202 9/1977 (JP) .
42495 4/1981 (JP) .
70100 4/1984 (JP) .
9212 1/1985 (JP) .

* cited by examiner

*Primary Examiner*—Minsun Oh Harvey
(74) *Attorney, Agent, or Firm*—Fulbright & Jaworski L.L.P.

(57) ABSTRACT

Input sound signals are accepted for presentation to a plurality of speakers where the number of physically present speakers is less than the number of input sound signals. The accepted signals are expanded and summed in a manner such that a listener perceives sounds as coming from the same number of speakers as there are input signals while having less speakers actually operational. In one embodiment there is shown a five input system having only two speakers. The system is functional when the inputs are stereo or monaural and when there are all five speakers available.

60 Claims, 7 Drawing Sheets

QX SINGLE FILTER

QX DUAL FILTER

FULL SOUND ENHANCEMENT USING MULTI-INPUT SOUND SIGNALS

RELATED APPLICATIONS

Reference is hereby made to commonly assigned and U.S. patent application METHOD AND SYSTEM FOR SOUND EXPANSION, Ser. No. 08/858,594, now issued as U.S. Pat. No. 5,974,153 filed concurrently herewith, and U.S. patent application STEREO ENHANCEMENT SYSTEM INCLUDING SOUND LOCALIZATION FILTERS Ser. No. 08/511,788, filed Aug. 7, 1995, now issued as U.S. Pat. No. 5,774,556 which applications are incorporated herein by reference.

TECHNICAL FIELD OF THE INVENTION

This invention relates to a sound enhancing system and more particularly to a system and method for providing full sound image coverage when a listener has less than the full compliment of speakers required to hear all of the available sound.

BACKGROUND OF THE INVENTION

There are sound systems available which provide a listener with a full sound experience such that the reproduced sound appears to come to the listener as though it were being played "live" in the presence of the listener.

The DOLBY (a trademark of Dolby Labs) surround systems are typical of such systems where a listener can enjoy a full range of sound spread out in a three dimensional pattern around the listener. One major drawback to such systems is that they require more than the traditional two (left and right) speakers. Typically, these systems require at least three (the third being a center speaker for speech and other "centered" sounds) and usually also require two rear speakers. For maximum enjoyment at least one sub-woofer is also required so that the listener can hear and perhaps even feel sounds in the range from 100 Hz and below. In addition, most existing surround systems provide the same sound to both rear speakers. An example of a system in which the rear speakers have the same sound signals is Dolby ProLogic.

New systems are coming on the market whereby an improvement has been made in that the rear speakers actually receive different sound signals thereby creating a left and right effect to the rear of the listener. An example of a prior art system in which the rear speakers have different sound signals is Dolby Digital (AC3).

The above-described systems assume a very import parameter that simply is not true in most situations. The assumption is that listeners of the sound system will have the five (or more) speakers necessary to take advantage of the full range of the sound systems. Most people simply can not afford to, or choose not to, install in their listening area the number (and quality) of speakers necessary for enjoyment of these full sound systems. Also, most people have more than one location from which they wish to listen to music, the TV, etc., and the need for five (or more) speakers limits their listening options considerably.

Furthermore, computer enthusiasts are precluded from taking advantage of the surround sound systems described above where use of more than two speakers is awkward.

Accordingly, a need exists in the art for a system which can accept the five sound signal inputs (left front, right front, center front, left rear and right rear) for a surround sound system and to convert those signal inputs for presentation to left and right front speakers while still maintaining the full sound experience for the listener.

A further need exists in the art for such a system in which the sound signal inputs for the rear speakers can be either the same or different for each speaker.

SUMMARY OF THE INVENTION

These and other objects and features of our invention are achieved by a system and method whereby in a first embodiment the five sound signal inputs from a full sound system (left front, right front, center, left rear, right rear) are converted to sound signals for presentation to left and right front speakers while preserving for the listener the perception that the sound is coming from fully around the listener. The system is designed such that speech and other front center speaker sounds still are perceived as coming from the center front while sounds which would be directed to the left and right rear speakers appear to the listener as coming from the same area as the "missing" rear speakers.

In an alternate embodiment, we have designed a system and method which will accept five sound signal inputs where the rear sound signals can be identical for both rear speakers or can be different for the two rear speakers.

In a second alternate embodiment, we have designed a system and method which will accept the five sound signal inputs and expand the sound from the front and rear pairs of speakers so that the sound appears to a listener to be coming from locations beyond the physical boundaries of the rive speakers.

The embodiments discussed above take advantage of sound expansion techniques known in the art and on techniques based on copending patent application entitled METHOD AND SYSTEM FOR SOUND EXPANSION. The prior art techniques for sound positioning are disclosed in U.S. Pat. Nos. 5,105,462 and 5,208,860 issued to Lowe et al. on Apr. 14, 1992, and May 4, 1993, respectively, which are hereby incorporated by reference herein, and which are illustrations of systems for positioning sound images at any desired location around a listener. The Lowe patents take a monaural sound image input and position that sound image at a selected location. The systems discussed in the above-identified patents is herein referred to as the Q1 system.

Techniques for stereo expansion are disclosed in U.S. Pat. No. 5,440,638 issued to Lowe et al. on Aug. 8, 1995 and incorporated by reference herein. The system discussed in the above identified patent is herein referred to as the QX system.

Thus, it is one technical advantage of our system and method that a five input sound signal system can be processed in a manner that will allow the sound to be expanded so that it will appear to a listener as though it emanates from five speakers while only two speakers are used.

It is a further technical advantage that the system will operate properly in situations where the sound signal inputs which would be directed to the two rear speakers have the same content and when they have different content.

It is a still further technical advantage of our system that it can be used in situations where the listener has five speakers placed around a listening area or when the listener has only two speakers and the sound input for the rear speakers is monaural or stereo.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Before beginning a detailed discussion of the operation of the various embodiments of our invention it should be noted that the detailed operation of the $1_2$3D, OMNI$_2$3D, Q1, single and dual QX circuits, various embodiments of which are shown in FIGS. 5, 6, 7, 8A and 8B, respectively, together with sound enhancement diagrams, can be found in the above-discussed copending patent application and patents. These details will not be repeated herein.

Figure 1A:
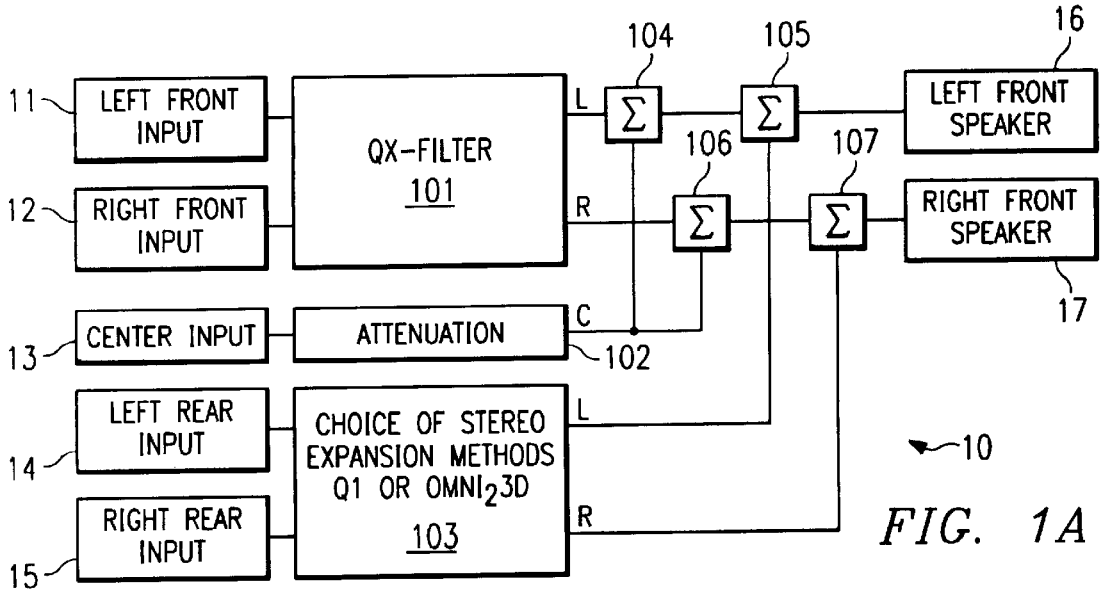
FIGS. 1A, 1B and 1C show embodiments of our invention for operation where the rear speaker inputs are different, together with a pictorial of the speaker placement and a diagram of the enhanced sound image as perceived by a listener.
Figure 1B:
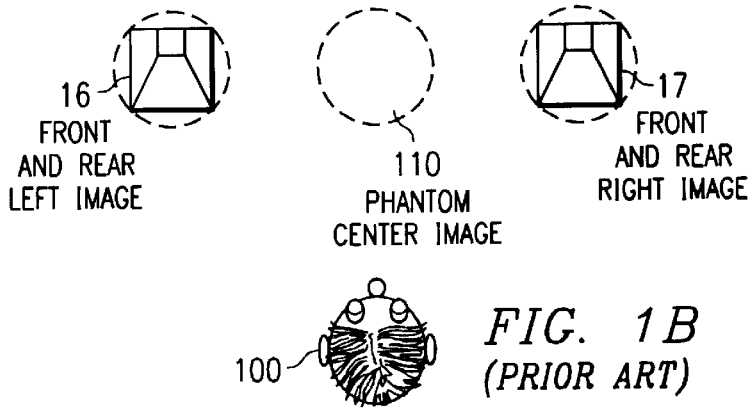
FIG. 1B (PRIOR ART)
Figure 1C:
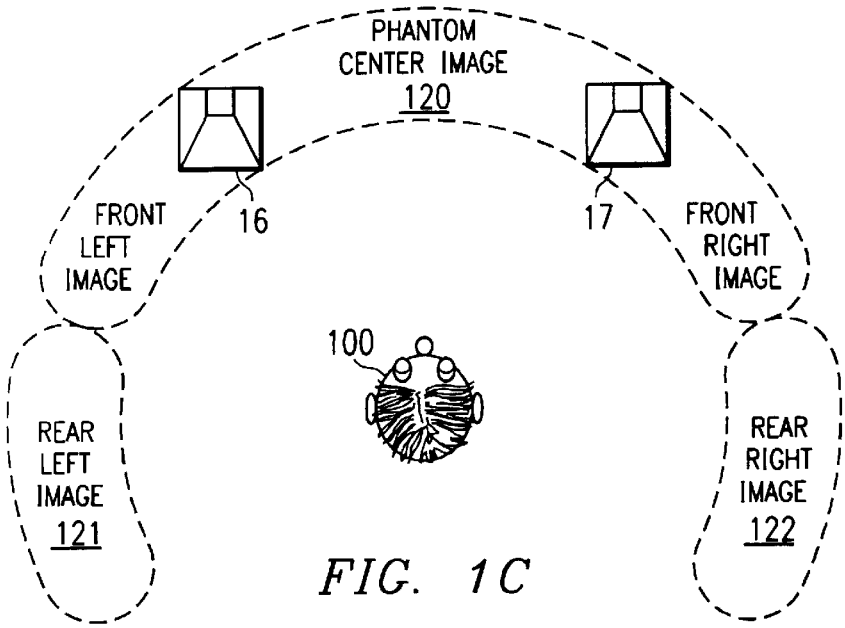

Turning now to FIG. 1A, there is shown circuit 10 which is designed to accept five sound signal inputs, 11, 12, 13, 14 and 15 and to combine the rear sound signals with the front sound images to provide an enhanced full dimensional sound output image to listener 100 via only left speaker 16 and right speaker 17. To date, prior art systems have only been able to combine five input signals to produce the left 16, right 17 and center 110 sound images as shown in FIG. 1B. FIG. 1C shows sound images 120, 121 and 122 perceived by listener 100 when the sound input signals are processed by circuit 10.

As shown in FIG. 1A left and right front inputs 11 and 12 are provided as respective inputs to QX filter 101. This QX filter can be either that shown in FIG. 8A or in FIG. 8B. The left and right outputs of filter 101 then form one input to each of summers 104 and 106, the other input to each of these summers is the output of attenuator 102. Attenuator 102 provides an attenuation of center input 13 in the range of −6 dB to zero with −3 dB in a preferred embodiment. The output of summers 104 and 106 are input to the input of summers 105 and 107, respectively. The other input to each of summers 105 and 107 come from the left and right outputs of expansion circuit 103. Note, that in situations where a center speaker is available, the input for the center speaker would be presented to the center speaker without attenuation and without being summed with the other speaker signals.

Figure 6:
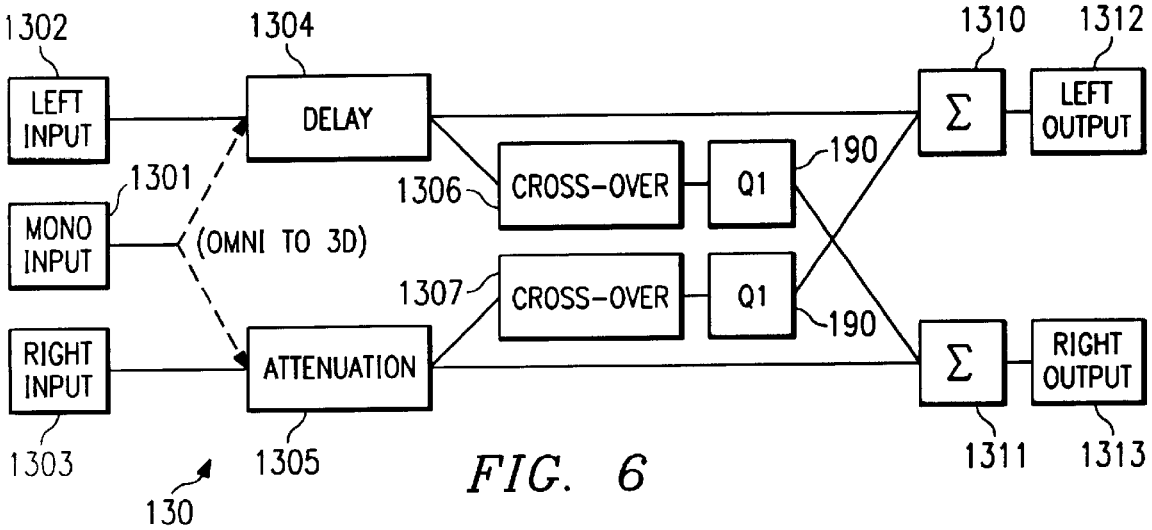
FIG. 6 shows an omni to stereo conversion circuit, also referred to as an OMNI$_2$3D circuit.
Figure 7:
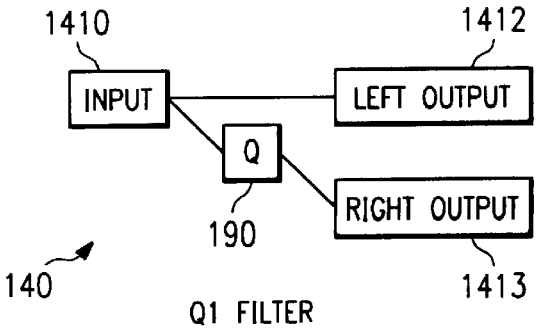
FIG. 7 (PRIOR ART)
FIG. 7 shows the prior art Q1 circuit for producing a left virtual image.

Expansion circuit 103 receives rear left and right stereo sound signal inputs 14 and 15 and converts that input to an expanded sound image by using a pair of the circuits shown in FIG. 7 or preferably the circuit shown in FIG. 6.

Figure 8A:
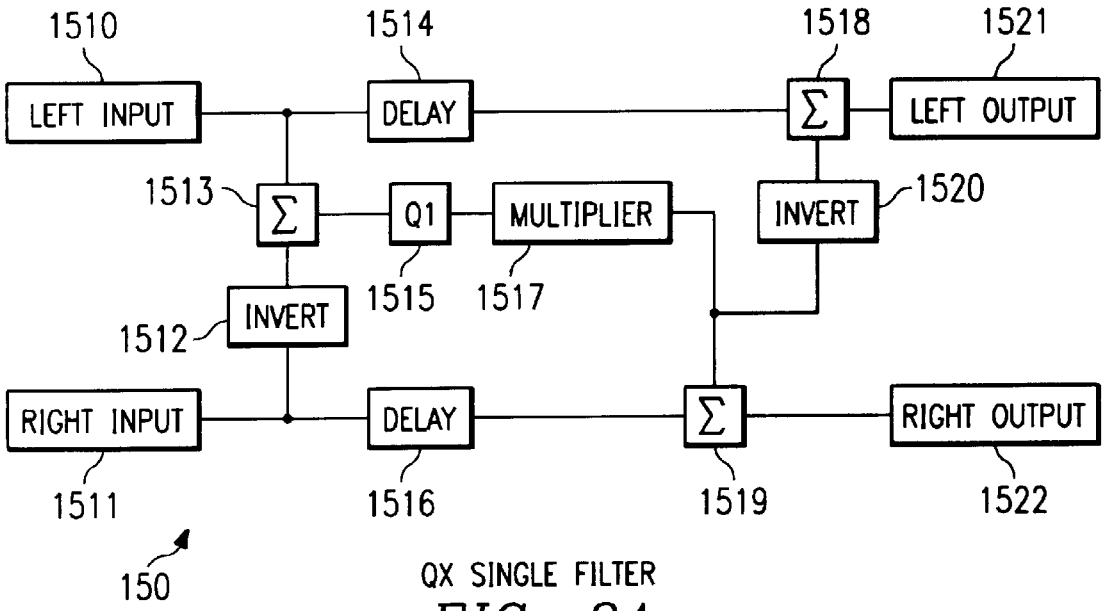
FIGS. 8A and 8B show different versions of the QX circuit.
Figure 8B:
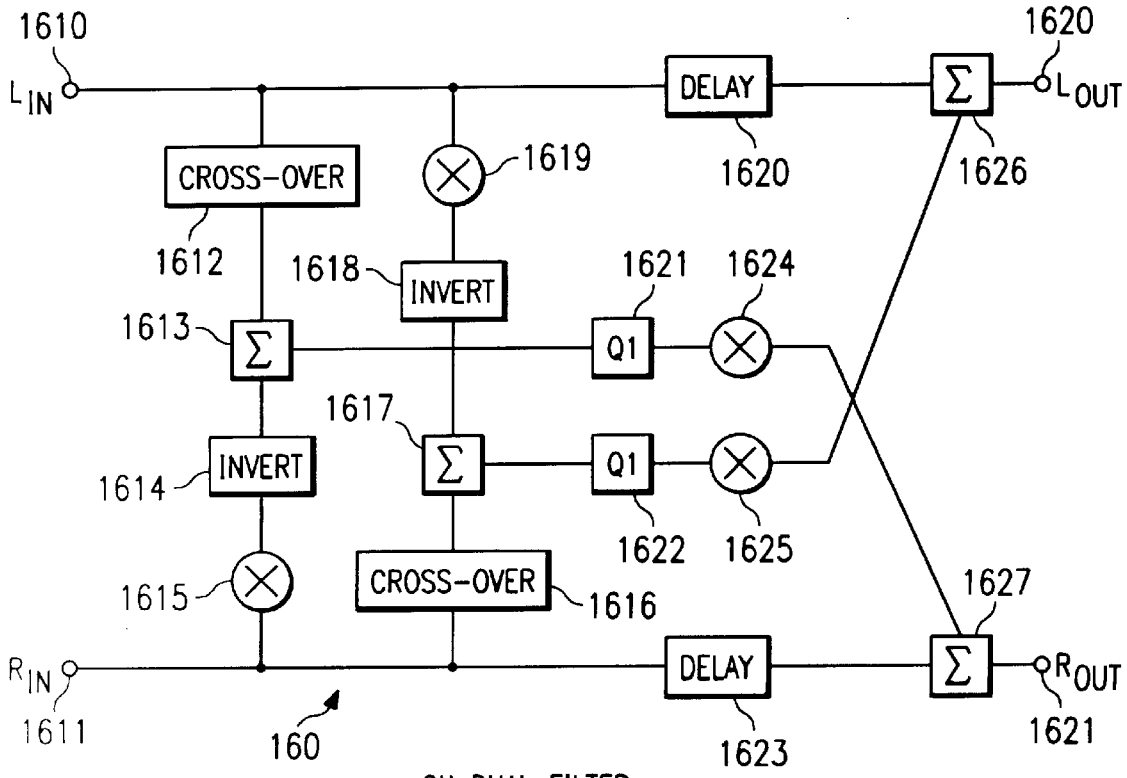
FIG. 8B (PRIOR ART)

In another embodiment, expansion circuit 103 may be comprised of either of the circuits shown in FIGS. 8A and 8B if attenuators 1615 and 1619 effectuate an attenuation in the range of approximately −20 dB to approximately −80 dB.

The output of summers 105 and 107 form the inputs to speakers 16 and 17 to create the sound enhanced image shown in FIG. 1C.

Figure 2A:
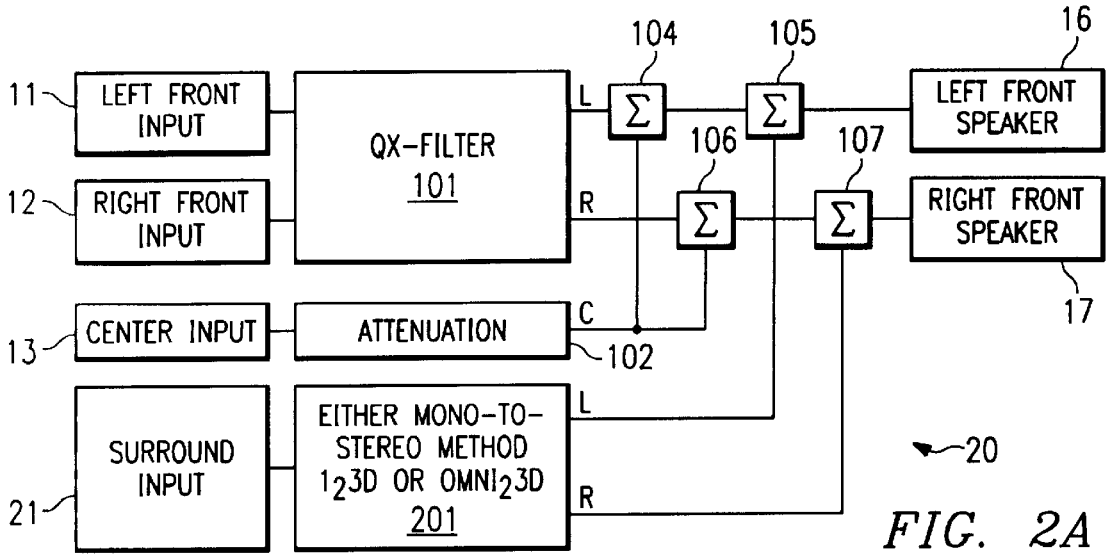
FIGS. 2A, 2B and 2C show other embodiments of our invention where the rear speaker inputs are the same, together with a pictorial of the speaker placement and a diagram of the enhanced sound image as perceived by a listener.
Figure 2B:
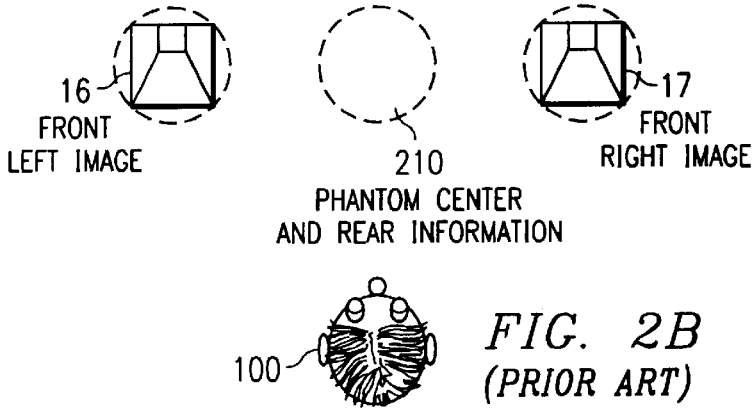
FIG. 2B (PRIOR ART)
Figure 2C:
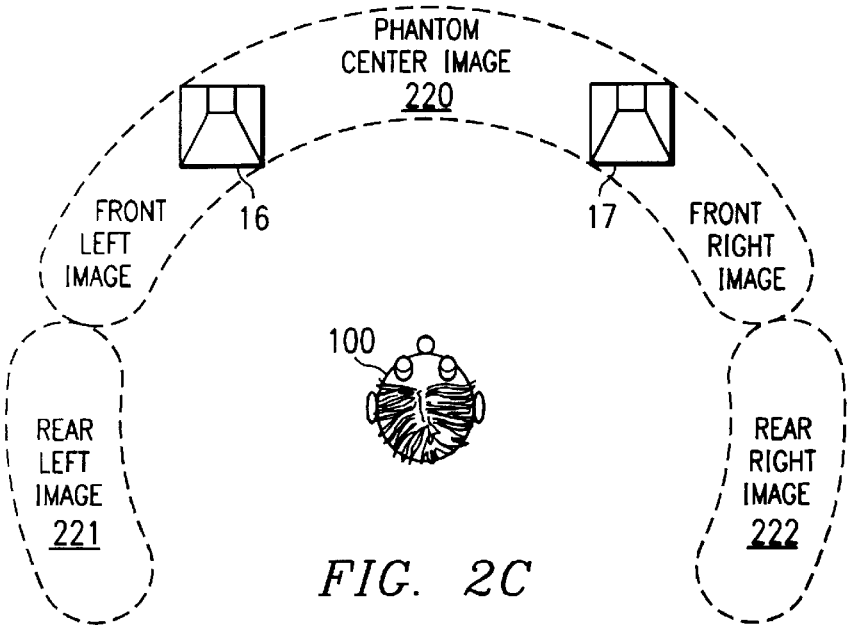

Turning now to FIG. 2A there is shown circuit 20 which is designed to accept four different sound signal inputs, 11, 12, 13, and 21, where input 21 is a monaural signal for presentation to the rear two speakers of a five-speaker system. Circuit 20 combines the rear sound signal inputs with the front sound signal inputs to provide an enhanced full dimensional sound output image to listener 100 via left speaker 16 and right speaker 17. To date, prior art systems have only been able to combine five input signals to produce the left 16, right 17, and center 210 sound images as shown in FIG. 2B. FIG. 2C shows sound images 220, 221 and 222 perceived by listener 100 when the sound input signals are processed by circuit 20.

As shown in FIG. 2A left and right front inputs 11 and 12 are provided as respective inputs to QX filter 101. As discussed above, this QX filter can be either that shown in FIG. 8A or in FIG. 8B. The left and right outputs of filter 101 then form one input to each of summers 104 and 106, the other input to each of these summers comes from a 3 dB attenuation, via box 102, of center input 13. The output of summers 104 and 106 are input to summers 105 and 107, respectively The other inputs to summers 105 and 107 come from the left and right outputs of expansion circuit 201.

Expansion circuit 201 receives a monaural sound signal 21, which can come from various sources such as, by way of example, from the rear "surround" outputs of the above-mentioned Dolby ProLogic system. Circuit 201 operates to convert that monaural input to an expanded sound image by using the circuit shown in FIG. 5 or preferably the circuit shown in FIG. 6.

The output of summers 105 and 107 form the inputs to speakers 16 and 17, respectively, to create the sound enhanced image shown in FIG. 2C.

Figure 3A:
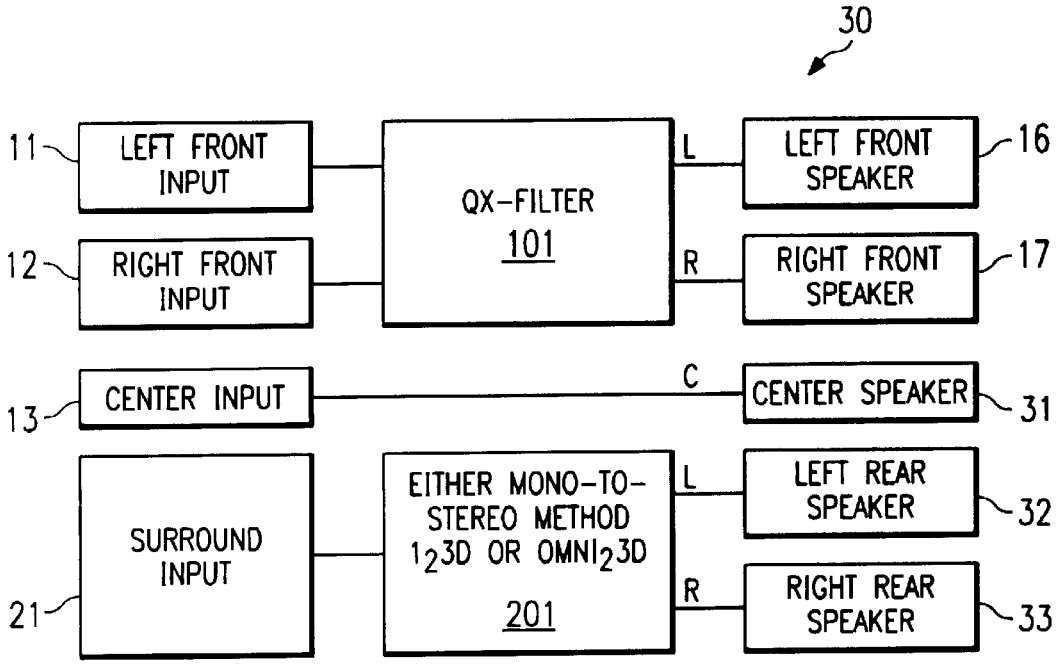
FIGS. 3A, 3B and 3C show still other embodiments of our invention for providing enhanced sound imaging for use in situations where the listener has five speakers and the sound signals for the rear speaker are monaural, together with a pictorial of the speaker placement and a diagram of the enhanced sound images as perceived by a listener.
Figure 3B:
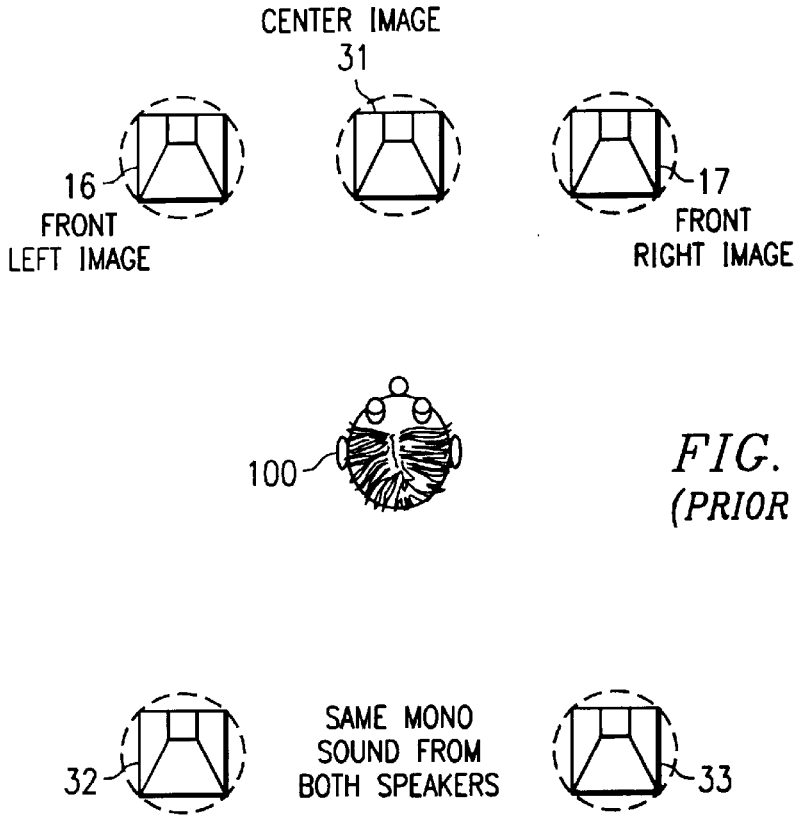
FIG. 3B (PRIOR ART)
Figure 3C:
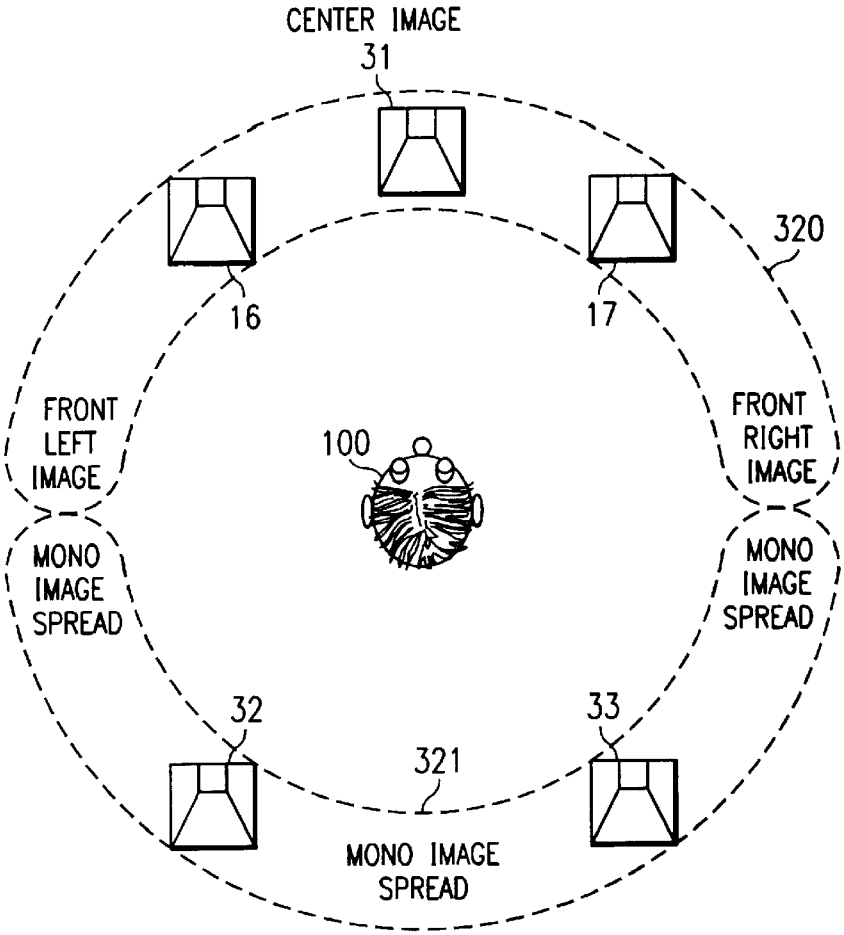

Turning now to FIG. 3A there is shown circuit 30 which is designed to accept four different sound signal inputs, 11, 12, 13, and 21, where input 21 is a monaural signal for presentation to the rear two speakers of a five-speaker system. Circuit 30 operates in situations where all five speakers are present to provide an enhanced full dimensional sound output image to listener 100 via left speaker 16, right speaker 17, center speaker 31, rear left speaker 32, and rear right speaker 33. FIG. 3B illustrates the sound images which are produced by prior art systems in which there are five input sound signals in which the input to the rear speakers is monaural. FIG. 3C shows sound images 320 and 321 perceived by listener 100 when the sound input signals are processed by circuit 30.

As shown in FIG. 3A left and right front inputs 11 and 12 are provided as respective inputs to QX filter 101. As discussed above, this QX filter can be either that shown in FIG. 8A or in FIG. 8B. The left and right outputs of filter 101 then form the input to the front left and right speakers 16 and 17 in a five-speaker system.

Center input 13 goes directly to center speaker 31 without modification.

Expansion circuit 201 receives a monaural sound signal 21, which can come from various sources such as, by way of example, from the rear "surround" outputs of the above-mentioned Dolby ProLogic sound system. Circuit 201 operates to convert that monaural input to an expanded sound image by using the circuit shown in FIG. 5 or preferably the circuit shown in FIG. 6. The output of circuit 201 forms the inputs to left rear and right rear speakers 32 and 33 to create the sound enhanced image shown in FIG. 3C.

Figure 4A:
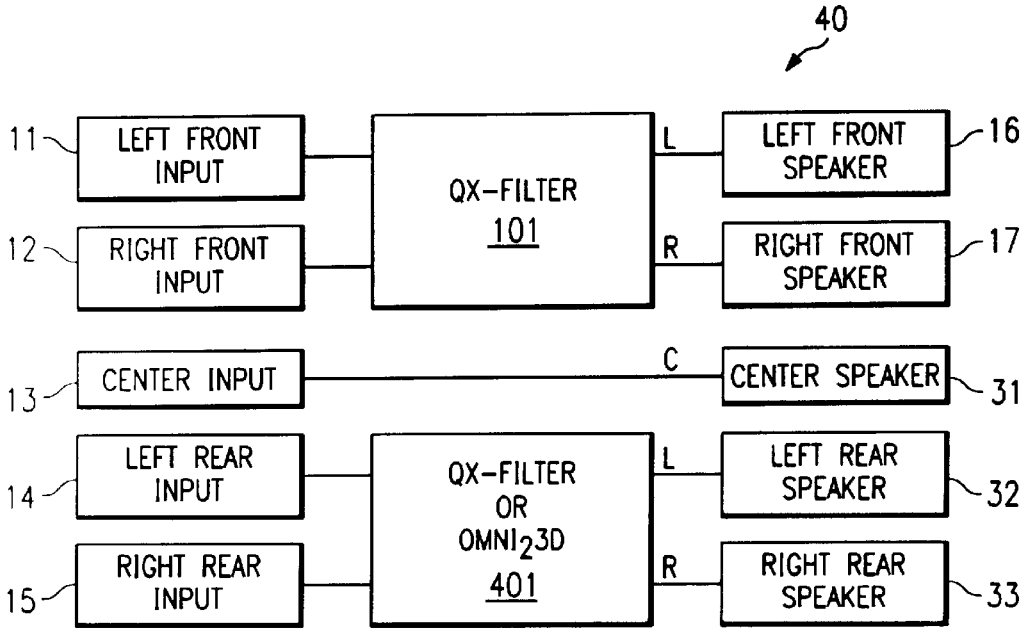
FIGS. 4A, 4B and 4C show still other embodiments of our invention for providing enhanced sound imaging for use in situations where the listener has five speakers and the sound signals for the rear speaker are stereo, together with a pictorial of the speaker placement and a diagram of the enhanced sound images as perceived by a listener.
Figure 4B:
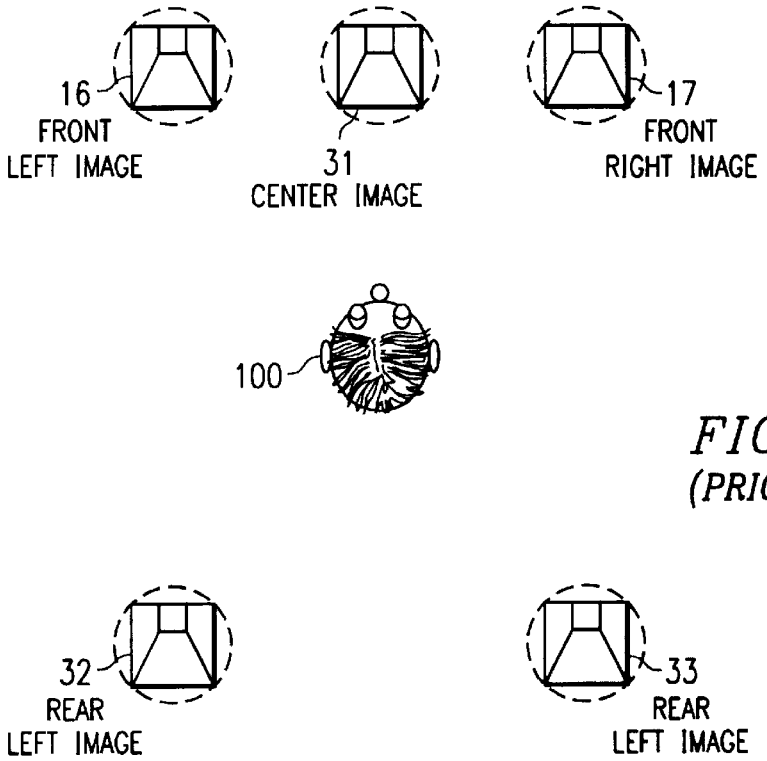
FIG. 4B (PRIOR ART)
Figure 4C:
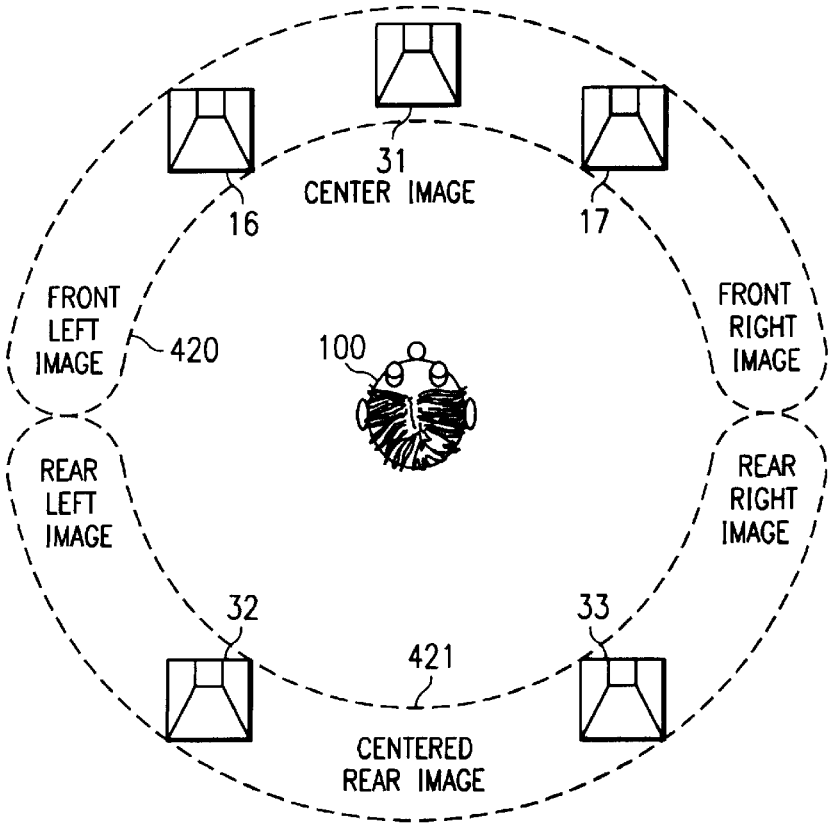
Figure 5:
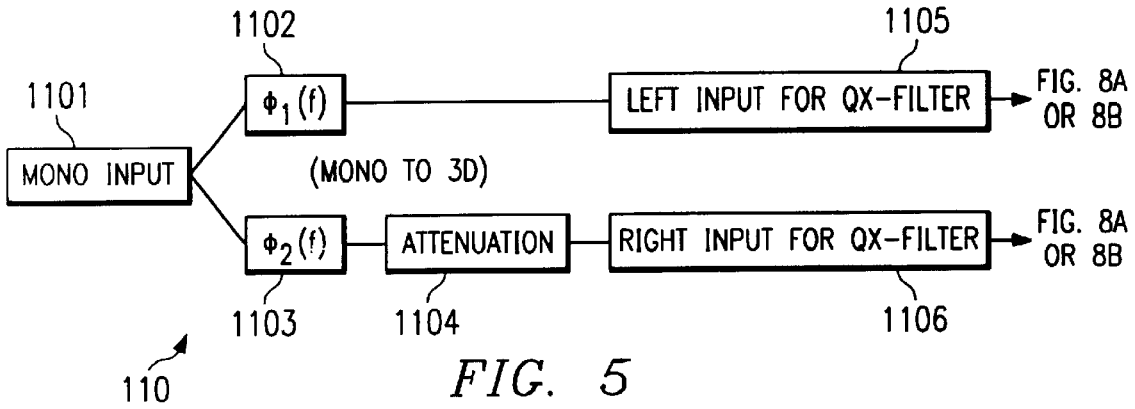
FIG. 5 shows a monaural to stereo conversion circuit, also referred to as a $1_2$3D circuit.

Turning now to FIG. 4A, there is shown circuit 40 which is designed to accept five different sound signal inputs, 11, 12, 13, 14 and 15, where inputs 14 and 15 are full stereo inputs for presentation to the rear two speakers 32 and 33 of a five-speaker system. Circuit 40 operates in situations where all five speakers are present to provide an enhanced full dimensional sound output image to listener 100 via left speaker 16, right speaker 17, center speaker 31, left rear speaker 32 and right rear speaker 33. FIG. 4B illustrates the sound images which are produced by prior art systems in which there are five input sound signals in which the input to the rear speakers is monaural. FIG. 4C shows sound images 420 and 421 perceived by listener 100 when the sound input signals are processed by circuit 40.

As shown in FIG. 4A, left and right front inputs 11 and 12 are provided as respective inputs to QX filter 101. As discussed above, this QX filter can be either that shown in FIG. 8A or in FIG. 8B. The left and right outputs of filter 101 then form the input to the front left and right speakers 16 and 17, respectively, in a five-speaker system.

Center input 13 goes directly to center speaker 31 without modification.

Expansion circuit 401 receives a stereo input signal 14 and 15, which can come from various sources such as, by way of example, from the rear speaker signals of the Dolby AC3 outputs of the above-mentioned Dolby surround sound system. Circuit 401 operates to enhance the stereo rear speaker input to an expanded sound image by using the circuit shown in FIGS. 8A or 8B or preferably the circuit shown in FIG. 6. The circuit shown in FIG. 8B can be used as shown or in a modified form with attenuators 1615 and 1619 set to −80 dB or greater. This enables the circuit in FIG. 8B to operate more like a pair of Q1 filters such as those used in the circuit in FIG. 6. The outputs of circuit 401 form the inputs to left rear and right rear speakers 32 and 33, respectively, to create the sound enhanced image shown in FIG. 4C.

It should be noted that the essential difference between FIGS. 1A, 2A and FIGS. 3A, 4A is the elimination of the summing circuits. The elimination of summing switches may be effectuated by a switch (not shown), thus permitting a single system to handle 2-, 3-, 4- or 5-speaker configurations. The use of subwoofers and other sound enhancement transducers is left out for convenience. The concepts discussed herein could work as well for such components.

Also note that as used herein, a two-speaker system is a system having right and left front sound transducers. A three-speaker system includes an additional center front speaker. A five-speaker system adds rear left and right (either stereo or monaural) speakers, while one four-speaker system eliminates the front center speaker. A second four-speaker configuration would have left front, center front, right front and a monaural surround sound speaker in the rear.

While the concepts of our invention are discussed in relation to Dolby sound systems they will work on any type of sound system having different front and rear sound input signals. One example of such other systems is the sound system for the DVD audio-visual format. The system can also be used with signals available from different sources such as from a telephone or computer system working in conjunction with a separate sound source. In addition, while a five input set of signals has been shown and discussed the number of input signals is not critical. Also, it is important to note that although it has been assumed that the front speaker input will be stereo the system will work with a monaural front speaker input by substituting the mono to expanded stereo process for the QX filter.

The invention can be arranged to work with various combinations of "n" input signals and "x" playback speakers. For example, a single input ("n=1") can be expanded to stereo ("x=2") or a set of left, center and right input signals ("n=3") can be processed to produce an expanded stereo sound field for playback over a pair of stereo speakers ("x=2"). Thus, the invention is very flexible since the number of inputs can be greater than the number of speakers ("n>x"), the number of inputs can be equal to the number of speakers ("n=x") or the number of inputs can be less than the number of speakers ("n<x").

Although the present invention and its advantages have been described in detail, it should be understood that various changes, substitutions and alterations can be made herein without departing from the spirit and scope of the invention as defined by the appended claims.

What is claimed is:

1. A system for accepting a set of n input signals for presentation to x speakers, where x is any number, and wherein one of said n input signals is a center speaker sound signal, said system comprising:

means for expanding in pairs certain of the signals for presentation to the x speakers;

means for expanding in pairs others of the input signals for presentation to the x speakers;

means when x is less than n for summing the expanded signal pairs for presentation to said x speakers; and means when x is less than n for summing said center speaker sound signal with one of said expanded pairs of input signals prior to said presentation to said x speakers.

2. The invention set forth in claim 1, further comprising means for attenuating said center sound signal prior to said summing of said center speaker signal.

3. The invention set forth in claim 2, wherein said attenuating is in the range of 0 dB to 6 dB.

4. The invention set forth in claim 1, wherein at least one of said expanding means includes a QX filter, wherein said QX filter provides an expanded stereo sound image.

5. The invention set forth in claim 1, wherein at least one of said expanding means includes an $OMNI_2$3D filter, wherein said $OMNI_2$3D filter provides an expanded surround sound image.

6. The invention set forth in claim 1, wherein at least one of said expanding means includes a pair of Q1 filters.

7. The invention set forth in claim 1, wherein n is 5 and x is 3.

8. The invention set forth in claim 1, wherein the first pair of input signals are for presentation to the front left and right speakers and wherein the other of said input pairs are for presentation to left and right rear speakers which are not physically present.

9. The invention set forth in claim 8, wherein the rear pair of input signals are either monaural or stereo.

10. The invention set forth in claim 9, wherein said other signal expansion means includes a pair of Q1 filters.

11. The invention set forth in claim 9, wherein said other signal expansion means includes an $OMNI_2$3D filter.

12. The invention set forth in claim 8, wherein the rear pair of input signals are monaural.

13. The invention set forth in claim 12, wherein said other signal expansion means includes an $OMNI_2$3D circuit.

14. The invention as set forth in claim 1, wherein at least one of said expanding means includes a QX dual filter.

15. The invention as set forth in claim 14, wherein said QX dual filter includes means for attenuating the signals input to said QX dual filter in the range of −20 dB to −80 dB.

16. A method for accepting a set of n input signals for presentation to x speakers, where x is any number, and wherein one of said n input signals is a center speaker sound signal said method comprising the steps of:

expanding in pairs certain of the signals for presentation to the x speakers;

expanding in pairs others of the input signals for presentation to the x speakers;

summing the expanded signal pairs when x is less than n for presentation to said x speakers; and summing said center speaker sound signal with at least one of said expanded pairs of input signals when x is less than n prior to said presentation to said x speakers.

17. The method set forth in claim 16, further comprising the step of:

attenuating said center sound signal prior to said summing of said center speaker signal.

18. The method set forth in claim 17, wherein said attenuation is in the range of 0 dB to 6 dB.

19. The method set forth in claim 16, wherein at least one of said expanding steps includes passing the sound signal through at least one QX filter, wherein said at least one QX filter provides an expanded stereo sound image.

20. The method set forth in claim 16, wherein at least one of said expanding steps includes the step of passing said sound signal through at least one $OMNI_2$3D filter, wherein said at least one $ONMI_2$3D filter provides an expanded surround sound image.

21. The method set forth in claim 16, wherein at least one of said expanding steps includes the step of passing said sound signal through a pair of Q1 filters.

22. The method set forth in claim 16, wherein the first pair of input signals are for presentation to front left and right speakers and wherein the other of said input pairs are for presentation to rear left and right speakers which are not physically available.

23. The method set forth in claim 22, wherein the rear pair of input signals can be either monaural or stereo.

24. A circuit for converting four input sound signals which are for presentation to four speakers, to two sound signals which are for presentation to two of the four speakers, wherein the four speakers arc left front, right front, left rear and right rear, and wherein the two speakers are the left front and the right front speakers, the circuit comprising:

means for passing the front left and right input signals through a QX filter to form a front output pair of signals having a left and right component to provide an expanded stereo sound image;

means for passing the rear input signals through a mono to stereo filter to form a rear output pair of signals having a left and right component to provide an expanded surround sound image, wherein said rear input sound signals for presentation to the rear left and rear right speakers can be monaural or stereo signals; and means for individually summing the left and right components of said front output pair of signals with the left and right components of said rear output pair of signals to form a single pair of left and right signals for presentation to said left front and right front speakers.

25. The circuit set forth in claim 24, wherein said input sound signals further include a center sound signal for presentation to a center front speaker and wherein said circuit further includes:

means operable when said center front speaker is not present for attenuating said center input sound signal; and means for presenting said attenuated signal to said individually summed front output pair of signals.

26. The circuit set forth in claim 25, wherein said attenuating means operates within the range of 0 dB to 6 dB.

27. A method for converting four input sound signals which are for presentation to four speakers, to two sound signals which are for presentation to two of the four speakers, wherein the four speakers are left front, right front, left rear and right rear, and wherein the two speakers are the left front and the right front speakers, comprising the steps of:

passing the front left and right input signals through a QX filter to form a front output pair of signals having a left and right component to provide an expanded stereo sound image;

passing the rear input signals through a mono to stereo filter to form a rear output pair of signals having a left and right component to provide an expanded surround sound image, wherein said rear input sound signals for presentation to the rear left and rear right speakers can be monaural or stereo signals; and individually summing the left and right components of said front output pair of signals with the left and right components of said rear output pair of signals to form a single pair of left and right signals for presentation to said left front and right front speakers.

28. The method set forth in claim 27, wherein said input sound signals further include a center sound signal for presentation to a center front speaker and wherein said method further includes the steps of:

attenuating said center input sound signal when said center front speaker is not present; and presenting said attenuated signal to said individually summed front output pair of signals.

29. The method set forth in claim 28, wherein when said rear input sound signals are monaural said method further includes the steps of:

converting said sound signals from monaural to stereo sound signals.

30. The method as set forth in claim 29, wherein said converting step includes the step of:

separating said monaural signal into two equal information content input signals having a phase relationship of approximately 60° with one of the input signals attenuated from the other; and applying each of these signals to respective inputs of a sound expansion sound circuit.

31. The method as set forth in claim 30, wherein the phase relationship is a phase delay and wherein the signal with the leading phase is the input signal that is attenuated.

32. The method as set forth in claim 30, wherein said attenuation is sufficient to provide an equal average loudness to a listener of sound from said transducers.

33. The method as set forth in claim 32, wherein said attenuation is sufficient to provide a sound image that is centered for a listener of sound.

34. The method as set forth in claim 32, wherein said attenuation is in the range of 0 dB to 6 dB.

35. The method as set forth in claim 30, wherein said phase relationship is applied over at least the range 100 Hz$\leqq$f$\leqq$10 KHz, where f is frequency.

36. A circuit for converting first input signals which contain sound signals for driving at least four sound producing transducers to second sound signals which drive three or less sound producing transducers, the circuit comprising:

means for sound expanding a first left and right pair of said first sound signals;

means for passing a second left and right pair of said first sound signals through a stereo producing circuit;

means for summing the output of said stereo producing circuit with the output of said sound expanding means for presentation to said three or less sound producing transducers;

means for accepting a sound input for driving a center speaker; and means, including attenuation means, for summing said accepted center sound signal with said summed other sound signals prior to presentation to said three or less sound producing transducers.

37. The circuit set forth in claim 36, wherein said stereo producing circuit includes:

means for accepting two input signals;

means for delaying a first one of said input signals with respect to the second one of said input signals;

means for attenuating said second input signal with respect to said first input signal;

means for creating from the delayed first input signal and from the attenuated second input signal two independent crossover signals having frequencies only above approximately 110 Hz;

means for passing each of said crossover signals through respective Q1 filters to create an output signal;

means for summing the output of the Q1 filter which is associated with the attenuated second input signal with the delayed first input signal to create a first output signal; and means for summing the output of the Q1 filter which is associated with the delayed first input signal with the attenuated second input to create a second output signal, said first and second outputs operable for driving spaced apart transducers to create an expanded stereo sound image signal of the input sound signal.

38. The circuit set forth in claim 37, further including:

means for splitting a monaural input signal to two equal input signals for presenting to said means for accepting two input signals.

39. The circuit set forth in claim 37, wherein said Q1 filter passing means includes:

means for inverting the input signal; and means for phase and amplitude adjusting the inverted signal.

40. The circuit set forth in claim 39, wherein said phase and amplitude adjusting means includes: means for adjusting the phase and amplitude on a frequency dependent basis.

41. The circuit set forth in claim 36, wherein said attenuation is in the range of 0 dB to 6 dB.

42. The circuit set forth in claim 36, wherein said stereo producing circuit includes an $OMNI_2$3D filter for providing an expanded surround sound image.

43. The circuit set forth in claim 36, wherein said means for sound expanding includes a QX filter for providing an expanded stereo sound image.

44. A method for converting first sound signals which contain sound signals for driving at least four sound producing transducers to second sound signals which drive three or less sound producing transducers, the method comprising:

sound expanding a first left and right pair of said first sound signals;

passing a second left and right pair of said first sound signals through the steps of a stereo producing method;

summing the output of said stereo producing method with the expanded output of said sound expanding step for presentation to said three or less sound producing transducers;

accepting a sound input for driving a center speaker;

attenuating said accepted center sound signal; and summing said accepted center sound signal with said summed other sound signals prior to presentation to said three or less sound producing transducers.

45. The method set forth in claim 44, wherein said stereo producing method comprises the steps of:

accepting two input signals;

delaying a first one of said input signals with respect to the second one of said input signals;

attenuating said second input signal with respect to said first input signal;

creating from the delayed first input signal and from the attenuated second input signal two independent crossover signals having frequencies only above approximately 110 Hz;

passing each of said crossover signals through respective Q1 filters to create an output signal;

summing the output of the Q1 filter which is associated with the attenuated second input signal with the delayed first input signal to create a first output signal; and summing the output of the Q1 filter which is associated with the delayed first input signal with the attenuated second input to create a second output signal, said first and second outputs operable for driving spaced apart transducers to create a stereo sound image signal of the input sound signal.

46. The method set forth in claim 45, further comprising the step of:

splitting a monaural input signal to two equal input signals for presenting to said input signal accepting step.

47. The method set forth in claim 45, wherein said Q1 filter passing step includes the step of:

inverting the input signal;

phase adjusting the inverted signal; and amplitude adjusting the phase adjusted signal.

48. The method set forth in claim 47, wherein said phase adjusting step includes the step of adjusting the phase on a frequency dependent basis; and wherein said amplitude adjusting step includes the step of adjusting the amplitude on a frequency dependent basis.

49. The method set forth in claim 44, wherein the attenuation in said attenuating step is in the range of 0 dB to 6 dB.

50. The method set forth in claim 44, wherein said stereo producing method utilizes an $OMNI_2$3D filter for providing an expanded surround sound image.

51. The method set forth in claim 44, wherein said sound expanding step utilizes a QX filter for providing an expanded stereo sound image.

52. A method for creating a stereo surround sound image for a listener positioned with respect to first and second sound transducers from a plurality of sound inputs which are directed to at least four transducers, where the sound inputs for the two speakers which have been eliminated are monaural, said method comprising the steps of:

accepting said sound inputs on two inputs;

attenuating one of said monaural inputs;

delaying the other one of said monaural inputs;

modifying each of said attenuated and delayed input signals by removing therefrom all frequencies below a cutoff frequency;

providing said modified signals to the respective inputs of Q1 filters;

summing the output of the attenuated signal Q1 filter with the delayed first input signal to provide a first output signal for presentation to the sound transducer; and summing the output of the delayed signal Q1 filter with the attenuated input signal to provide a second output signal for presentation to the second sound transducer.

53. The method set forth in claim 52, wherein said cutoff frequency is 110 Hz.

54. The method set forth in claim 53, wherein said Q1 filters invert, phase adjust and amplitude adjust the presented signals.

55. The method set forth in claim 54, wherein said phase adjustment is different for different frequencies.

56. A system for accepting a plurality of input signals for presentation to a plurality of speakers, said system comprising:

means for creating virtual sound images by expanding in pairs certain of the input signals for presentation to the plurality of speakers;

means for creating virtual sound images by expanding in pairs others of the input signals for presentation to the plurality of speakers, wherein at least one of said means, for creating virtual sound images includes a OX filter; and means for summing the expanded signal pairs for presentation to said plurality of speakers when the number of the plurality of speakers is less than the number of the plurality of input signals.

57. A circuit for converting first input signals which contain sound signals for driving at least four sound producing transducers to second sound signals which drive three or less sound producing transducers, the circuit comprising:

means for sound expanding a first left and right pair of said first sound signals;

means for passing a second left and right pair of said first sound signals through a stereo producing circuit, wherein said stereo producing circuit includes:

means for accepting two input signals;

means for delaying a first one of said input signals with respect to the second one of said input signals;

means for attenuating said second input signal with respect to said first input signal;

means for creating from the delayed first input signal and from the attenuated second input signal two independent crossover signals having frequencies only above approximately 110 Hz;

means for passing each of said crossover signals through respective Q1 filters to create an output signal;

means for summing the output of the Q1 filter which is associated with the attenuated second input signal with the delayed first input signal to create a first output signal; and means for summing the output of the Q1 filter which is associated with the delayed first input signal with the attenuated second input signal to create a second output signal, said first and second output signals operable for driving spaced apart transducers to create an expanded stereo sound image signal of the input sound signal; and means for summing the output of said stereo producing circuit with the output of said means for sound expanding for presentation to said three or less sound producing transducers.

58. A circuit for converting first input signals which contain sound signals for driving at least four sound producing transducers to second sound signals which drive three or less sound producing transducers, the circuit comprising:

means for sound expanding a first left and right pair of said first sound signals;

means for passing a second left and right pair of said first sound signals through a stereo producing circuit;

means for summing the output of said stereo producing circuit with the output of said sound expanding circuit for presentation to said three or less sound producing transducers;

means for accepting a sound input for driving a center speaker, wherein said center speaker is a virtual speaker; and means, including attenuation means, for summing said accepted center sound signal with said summed other signals prior to presentation to said three or less sound producing transducers.

59. A method for converting first sound signals which contain sound signals for driving at least four sound producing transducers to second sound signals which drive three or less sound producing transducers, the method comprising:

sound expanding a first left and right pair of said first sound signals;

passing a second left and right pair of said first sound signals through the steps of a stereo producing method, wherein said stereo producing method comprises the steps of:

accepting two input signals;

delaying a first one of said input signals with respect to the second one of said input signals;

attenuating said second input signal with respect to said first input signal;

creating from the delayed first input signal and from the attenuated second input signal two independent crossover signals having frequencies only above approximately 110 Hz;

passing each of said crossover signals through respective Q1 filters to create an output signal;

summing the output of the Q1 filter which is associated with the attenuated second input signal with the delayed first input signal to create a first output signal; and summing the output of the Q1 filter which is associated with the delayed first input signal with the attenuated second input signal to create a second output signal, said first and second outputs operable for driving spaced apart transducers to create a stereo sound image signal of the input sound signal; and summing the output of said stereo producing method with the expanded output of said sound expanding step for presentation to said three or less sound producing transducers.

60. A method for converting first sound signals which contain sound signals for driving at least four sound producing transducers to second sound signals which drive three or less sound producing transducers, the method comprising:

sound expanding a first left and right pair of said first sound signals;

passing a second left and right pair of said first sound signals through the steps of a stereo producing method;

summing the output of said stereo producing method with the expanded output of said sound expanding step for presentation to said three or less sound producing transducers;

accepting a sound input for driving a center speaker, wherein said center speaker is a virtual speaker;

attenuating said accepted center sound signal; and summing said accepted center sound signal with said summed other sound signals prior to presentation to said three or less sound producing transducers.

* * * * *